US009082568B2

(12) United States Patent
Laicher et al.

(10) Patent No.: US 9,082,568 B2
(45) Date of Patent: Jul. 14, 2015

(54) SWITCH, IN PARTICULAR FOR AN ELECTRIC PARKING BRAKE

(75) Inventors: Gebhard Laicher, Stockach (DE); Horst Singer, Radolfzell (DE)

(73) Assignee: TRW AUTOMOTIVE ELECTRONICS & COMPONENTS GMBH, Radolfzell (DE)

( * ) Notice: Subject to any disclaimer, the term of this patent is extended or adjusted under 35 U.S.C. 154(b) by 140 days.

(21) Appl. No.: 13/704,318

(22) PCT Filed: May 5, 2011

(86) PCT No.: PCT/EP2011/002254

§ 371 (c)(1), (2), (4) Date: Feb. 7, 2013

(87) PCT Pub. No.: WO2012/010226

PCT Pub. Date: Jan. 26, 2012

(65) Prior Publication Data

US 2013/0213787 A1 Aug. 22, 2013

(30) Foreign Application Priority Data

Jul. 19, 2010 (DE) ..... 10 2010 027 569

(51) Int. Cl.

| | |
|---|---|
| ***H01H 13/00*** | (2006.01) |
| ***H01H 23/02*** | (2006.01) |
| ***H01H 23/30*** | (2006.01) |
| ***H01H 23/00*** | (2006.01) |
| ***H01H 23/20*** | (2006.01) |
| *H01H 23/16* | (2006.01) |
| *H01H 21/22* | (2006.01) |

(52) U.S. Cl.

CPC ..... *H01H 23/02* (2013.01); *H01H 23/003* (2013.01); *H01H 23/205* (2013.01); *H01H 23/30* (2013.01); *H01H 23/168* (2013.01); *H01H 2021/225* (2013.01)

(58) Field of Classification Search

CPC ..... H01H 23/30
USPC ..... 200/553, 556, 557, 561, 339
See application file for complete search history.

(56) References Cited

U.S. PATENT DOCUMENTS

| | | | | |
|---|---|---|---|---|
| 5,115,108 | A | 5/1992 | Ogawa et al. | |
| 5,486,669 | A * | 1/1996 | Oshgan | 200/557 |
| 5,834,716 | A | 11/1998 | Lee | |
| 6,438,416 | B1 | 8/2002 | Michel | |
| 2004/0188235 | A1 | 9/2004 | Sugimoto et al. | |

FOREIGN PATENT DOCUMENTS

| | | |
|---|---|---|
| DE | 4104572 | 8/1991 |
| DE | 4431937 | 3/1996 |
| DE | 10119558 | 11/2002 |
| DE | 102004036844 | 3/2006 |
| DE | 602004000138 | 5/2006 |

(Continued)

*Primary Examiner* — Felix O Figueroa
(74) *Attorney, Agent, or Firm* — Taroll, Sundheim, Covell & Tummino LLP

(57) ABSTRACT

A switch is shown which has a housing (10, 12), a key (20) that is pivotally mounted on the housing (10, 12), a rocker switch (22) that is assigned to the key (20) and can be actuated by the latter in two directions, so that it is pivoted about two axes spaced apart from each other, and two microswitches (16) that are arranged on the side of the rocker switch (22) facing away from the key (20).

11 Claims, 4 Drawing Sheets

(56) References Cited

FOREIGN PATENT DOCUMENTS

| | | |
|---|---|---|
| DE | 102006040304 | 3/2008 |
| EP | 0884744 | 12/1998 |
| JP | 3236124 | 10/1991 |

* cited by examiner

SWITCH, IN PARTICULAR FOR AN ELECTRIC PARKING BRAKE

RELATED APPLICATIONS

This application corresponds to PCT/EP2011/002254, filed Mar. 5, 2011, which claims the benefit of German Application No. 10 2010 027 569.7, filed Jul. 19, 2010, the subject matter, of which are incorporated herein by reference in their entirety.

BACKGROUND OF THE INVENTION

The present invention relates to a switch, in particular for actuating an electric parking brake in a motor vehicle.

Many designs of switches of this kind are known.

SUMMARY OF THE INVENTION

The object of the invention consists in further developing the known switches to the effect that a switch is provided which requires little space, can be assembled at low cost, and has a switching haptics that can be adjusted to the respective requirements.

To achieve this object, according to the invention provision is made for a switch including a housing, a key that is pivotally mounted on the housing, a rocker switch that is assigned to the key and can be actuated by the latter in two directions, so that it is pivoted about two axes spaced apart from each other, and two microswitches that are arranged on the side of the rocker switch facing away from the key. The invention is based on the fundamental idea of using two different axes about which the rocker switch is pivoted depending on its direction of actuation, rather than arranging the rocker switch in the housing a fixed bearing. This results in small space requirements. In addition, it is no longer necessary to mount the rocker switch at a defined bearing in the housing; it merely needs to be inserted.

Preferably, provision is made that the rocker switch is urged to an initial position by a spring tappet. The spring tappet, together with the housing, provides that the rocker switch is in a defined initial position when the key is in a non-actuated condition.

Provision is preferably made that the rocker switch is arranged within a guide collar of the housing. The guide collar constitutes a mechanically very simple guide means for the rocker switch.

According to a preferred embodiment, provision is made that, depending on the direction of actuation of the key, the rocker switch is pivoted about the edge of the rocker switch that is remote from the non-actuated side of the rocker switch. For example, when the rocker switch is depressed on its right-hand side, its left-hand edge remains in contact with the housing, for example on the guide collar, so that the rocker switch is not required to move on its left-hand side in opposition to its actuated side, but, rather, is actuated as a whole in the nature of a one-armed lever. Viewed in the direction of actuation, this results in very small space requirements.

Preferably, it is provided that an actuating contour for each direction of actuation is arranged on the side of the rocker switch facing the key. The actuating contour, which may be formed by a ramp, for example, allows a transmission ratio to be produced by which an actuating travel exercised by the key is translated to a larger switching travel. In addition, based on the geometry of the actuating contour, the switching haptics may be adjusted as desired.

According to the preferred embodiment, provision is made that the ramp is made to be two-sided and has a peak that defines a maximum permissible actuating travel. If, for example, violent actuation causes the key to be pressed farther than is provided for by design and than is conducive to the service life of the microswitches, this will not result in any stronger actuation of the rocker switch since, after having passed the peak, the part of the actuating key that cooperates with the rocker switch will reach a descending section of the ramp again, as a result of which no further actuating travel is developed.

Preferably, provision is made that the key cooperates with a spring-loaded pin which urges it into an initial position. In this way, the key is reset independently of the rocker switch.

Provision is preferably made here that the key includes a guide channel accommodating the pin and a spring, the spring being supported at one end of the pin, and in that the housing includes a return slide path against which the pin is pressed by the spring. The return slide path can be used for controlling the actuating haptics of the switch in the desired manner.

BRIEF DESCRIPTION OF THE DRAWINGS

The invention will now be described below with reference to an embodiment which is illustrated in the accompanying drawings, in which.

DESCRIPTION OF EXEMPLARY EMBODIMENT

The Figures show a switch that can be used for switching a plurality of circuits. The switch comprises a housing that includes a base plate 10 and a top part 12. Arranged inside the housing is a printed circuit board 14 having two microswitches 16 arranged thereon. The term "microswitch" in this connection means an assembly in which a mechanical actuation causes at least two electric conductors to make contact with each other or causes the contact between the two conductors to be broken.

Figure 1:
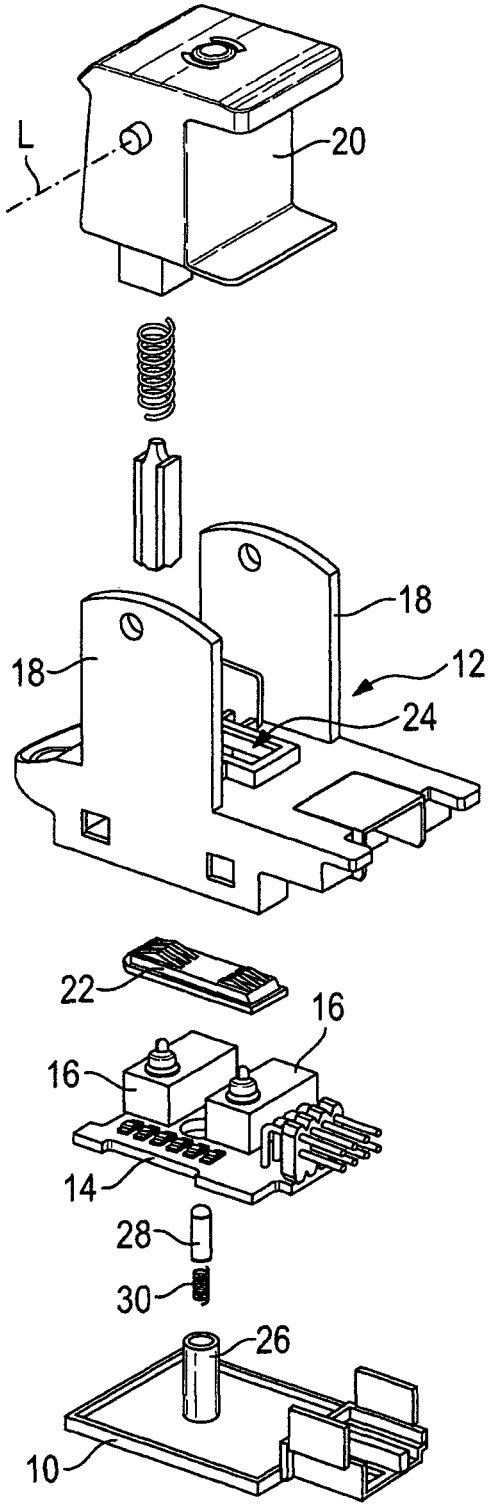
FIG. 1 shows an exploded view of a switch according to the invention.
Figure 2:
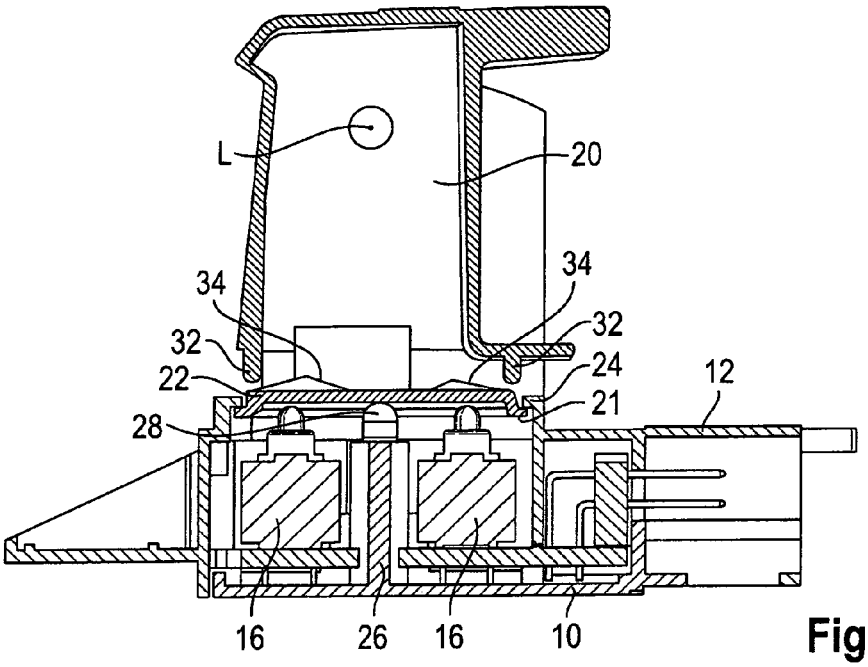
FIG. 2 shows a sectional view of the switch in the non-actuated condition.

A key 20 is mounted at the top part 12 of the housing in a pair of bearing legs 18, so that it can be pivoted in two directions of actuation. With reference to FIG. 2, the key 20 can be pivoted about its bearing axis L clockwise and counterclockwise.

Accommodated in the housing, more precisely in the top part 12, is a rocker switch 22 which has a generally rectangular shape. It includes an edge 21 which is made in the form of a continuously surrounding recessed shoulder. This edge 21 rests against a guide collar 24 which surrounds an opening of the top part 12 of the housing.

Below the rocker switch 22, a spring tappet 28 is mounted in a guide bush 26 that is fitted on the base plate 10 of the housing, the spring tappet 28 being urged against the rocker switch 22 under the action of a spring 30. The spring tappet 28 thereby presses the rocker switch 22 by its stepped edge 21 out of the inside of the housing and against the guide collar 24. As can be seen in FIG. 2, the two microswitches 16 are arranged here on either side of the spring tappet 28.

Figure 3:
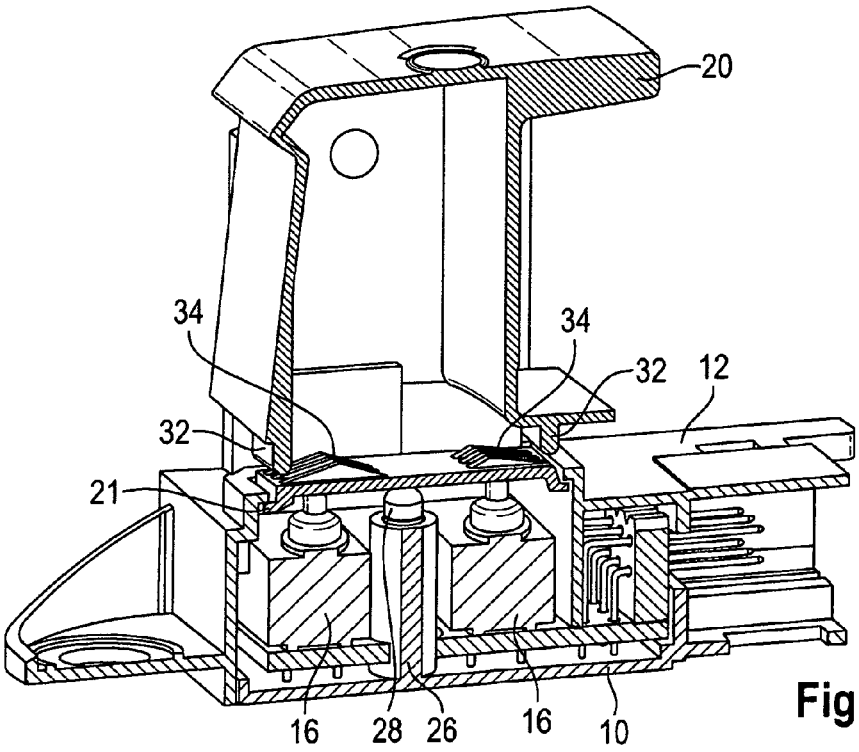
FIG. 3 shows a perspective illustration corresponding to the view of FIG. 2.

On its side facing the rocker switch 22, the key 20 includes two actuating ribs 32 which lie opposite from the rocker switch at a small distance. The side of the rocker switch 22 facing the key 20 is provided here with two actuating contours in the form of two-sided ramps 34 which are each located opposite from the respective actuating rib 32 of the key 20 at a small distance (see FIG. 2). Starting from the edge that is assigned to the respective actuating rib 32 of the key 20, each ramp 34 ascends towards the middle of the rocker switch as far as to a peak and then descends again. Here, the length of each ramp is smaller than half the length of the rocker switch. As can be seen in FIG. 3, the ramps are formed by a plurality of ribs arranged parallel next to each other, which reduces the susceptibility to contamination.

Figure 4:
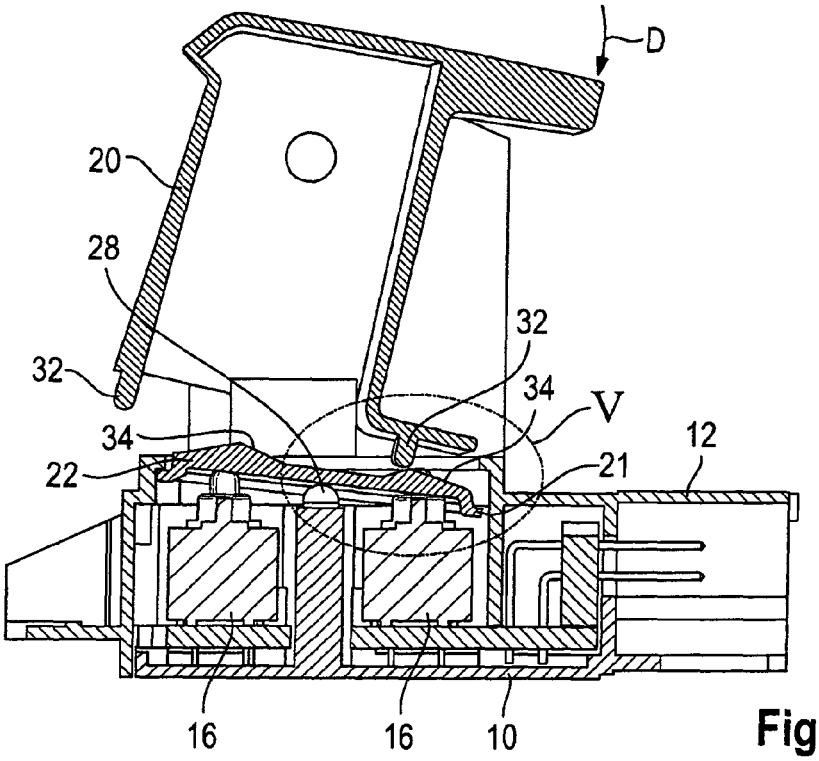
FIG. 4 shows a section taken through the switch of FIG. 2 in the actuated condition.
Figure 5:
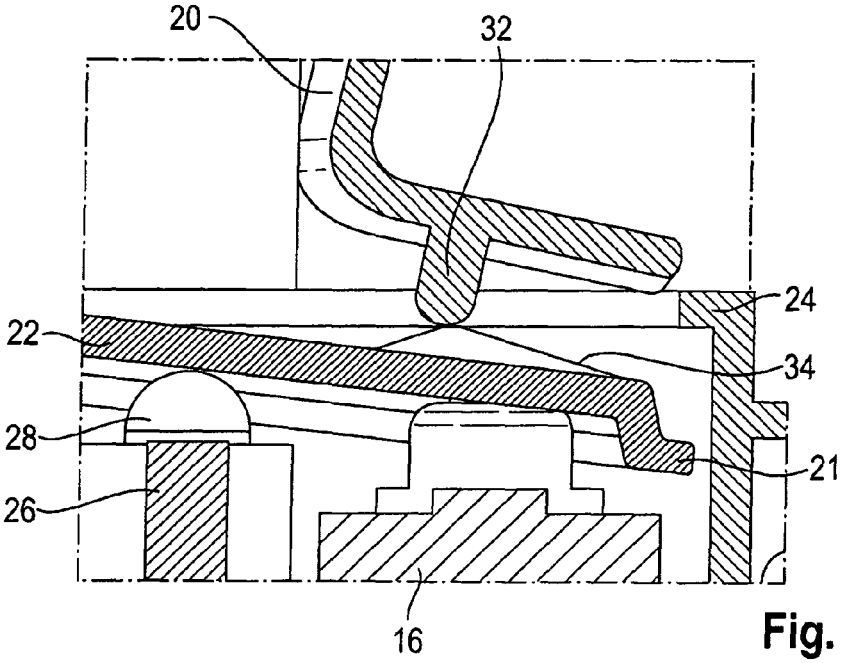
FIG. 5 shows the detail V of FIG. 4 on an enlarged scale.

Proceeding from the initial position shown in FIGS. 2 and 3, the key 20 can be shifted by pulling or pushing in one or the other direction. As an example of an actuation, FIGS. 4 and 5 show the condition in which the key 20 has been shifted about its bearing axis L by pushing clockwise in the direction of the arrow D. When the key is pivoted, the actuating rib 32 makes a pivoting motion about the bearing axis L, as a result of which, after overcoming the distance between itself and the rocker switch, it comes into contact with the ramp on the right-hand side in the Figures. Upon further pivoting of the key 20, the actuating rib slides inwards on the ramp, causing the rocker switch 22 to be pressed downwards on its right-hand side. In the process, the action of the spring tappet 28 needs to be overcome. The spring tappet 28 also makes sure that the edge 21 of the rocker switch 22 which is on the left in the Figures remains in engagement with the guide collar 24. The contact line between the left edge 21 of the rocker switch 22 and the guide collar 24 thus constitutes the axis about which the rocker switch 22 is pivoted downwards during the actuation shown in FIGS. 4 and 5. This causes its right-hand edge to be released from the guide collar 24, and the spring tappet 28 is pushed in downwards. As soon as the clearance between the free end of the microswitch 16 and the lower side of the rocker switch 22 has been overcome, the microswitch 16 is actuated. The clearance between the lower side of the rocker switch and the microswitches 16 and also the lever conditions ensure here that the left-hand microswitch is not actuated.

Owing to the ascent of the ramp 34, the distance covered by the actuating rib 32 on the key 20 in the vertical direction during the pivoting motion, that is, downwards, is translated to a larger actuating travel of the rocker switch. The maximum actuating travel is reached in the condition shown in FIG. 5, in which the actuating rib 32 is situated in the region of the peak of the ramp 34. This condition also corresponds to the maximum pivoting motion of the key 20 as provided by design. Should the key be pivoted beyond the position shown, for example by a violent actuation, the actuating rib 32 of the key 20 will slip over the peak of the ramp 34 and will reach the region of the ramp that descends again. This prevents the rocker switch 22 from being depressed still further.

When the key 20 is released again, the rocker switch 22 will return to its normal position under the action of the spring tappet 28 again, in which normal position it rests against the lower side of the guide collar 24 on both sides.

When the key is actuated in the opposite direction, the rocker switch 22 is pressed downwards accordingly on its left-hand side, so that the right-hand edge of the rocker switch 22 together with the guide collar 24 then constitutes the pivot axis.

Figure 6:
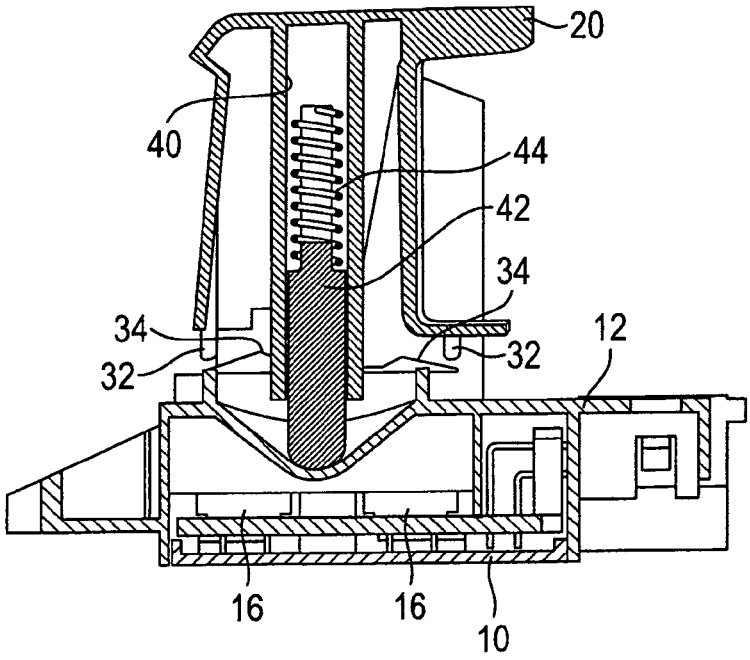
FIG. 6 shows a further sectional view of the switch in the non-actuated condition.
Figure 7:
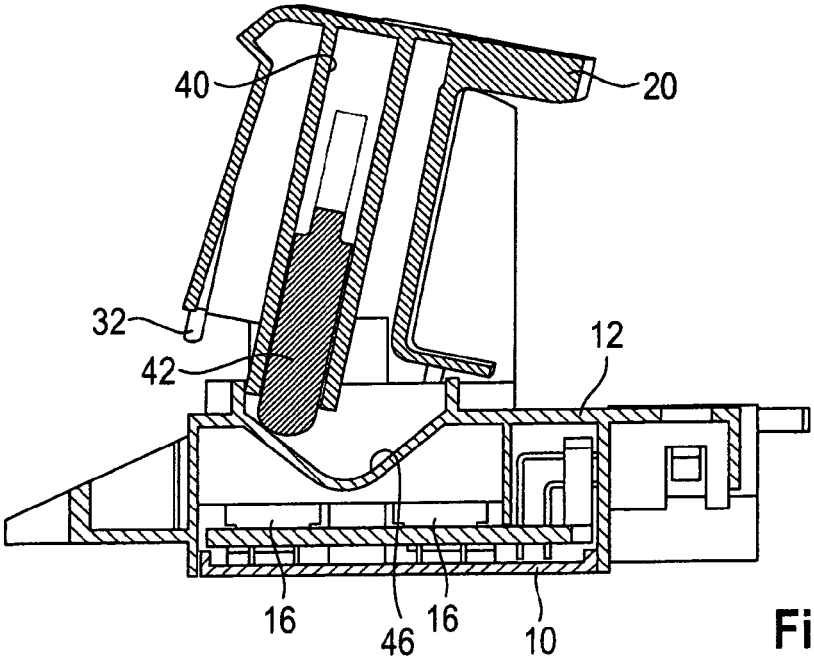
FIG. 7 shows the switch of FIG. 6 in the actuated condition.

FIGS. 6 and 7 show how the key 20 is returned to its initial position. Provided inside the key is a guide channel 40 having a pin 42 accommodated therein which is urged out from the channel by a spring 44. A return slide path 46, which has a V-shaped design as viewed in cross-section, is arranged in the housing below the key 20. The vertex of the V here defines the center position of the key (see FIG. 6). When the key is actuated in either direction, the pin 42 slides upwards in the channel 40, contrary to the action of the spring 44. A self-aligning moment is exerted on the key 20 by the slope of the return slide path.

The operating haptics of the switch can be adjusted in the desired manner by both the geometry of the return slide path 46 and the geometry of the ramps 34 on the rocker switch 22. In addition, by suitably designing the ramps 34, the fact that in the exemplary embodiment shown, the bearing axis L is not arranged in the middle between the two microswitches 16, but slightly offset laterally, can be compensated for. By using ramps 34 of different heights, it can be ensured that the same actuating travel of the rocker switch 22 is nonetheless produced in each direction of actuation.

The invention claimed is:

1. A switch comprising a housing (10, 12), a key (20) pivotally mounted on the housing (10, 12), a rocker switch (22) arranged to be actuated on a first side by the key (20) to move the rocker switch (22) in two directions, such that the rocker switch (22) is pivoted, respectively, about two axes spaced apart from each other, and two microswitches (16) arranged at a second side of the rocker switch (22) facing opposite from the key (20), wherein an actuating contour (34) is arranged on the first side of the rocker switch (22) facing the key (20) for each position of actuation of the key (20), and wherein the actuating contour is formed by a two-sided ramp (34) having a peak that defines a maximum permissible actuating travel distance of the rocker switch (22).

2. The switch according to claim 1, wherein the rocker switch (22) is urged to an initial position by a spring tappet (28).

3. The switch according to claim 1, wherein the rocker switch (22) is arranged within a guide collar (24) of the housing (10, 12).

4. The switch according to claim 1, wherein, depending on the position of actuation by the key (20), the rocker switch (22) is pivoted about a side edge of the rocker switch (22) that is remote from an opposite, non-actuated side edge of the rocker switch (22).

5. The switch according to claim 1, wherein the key (20) cooperates with a spring-loaded pin (42) which urges the key into an initial position.

6. The switch according to claim 5, wherein the key (20) includes a guide channel (40) accommodating the pin (42) and a spring (44), the spring (44) being supported at one end of the pin (42), and wherein the housing (10, 12) includes a return slide path (46) against which the pin (42) is pressed by the spring (44).

7. The switch according to claim 1, wherein the two-sided ramp (34) is formed by a plurality of ribs arranged parallel to one another.

8. The switch according to claim 1, wherein the key (20) includes a pair of spaced apart actuating ribs (32), each rib (32) cooperating with one of the two-sided ramps (34) to define the maximum permissible actuating travel distance of the rocker switch (22).

9. The switch according to claim 1 further comprising a spring tappet (28) spaced from the microswitches (16) that engages the rocker switch (22) and urges the rocker switch (22) towards the key (20) to an initial position.

10. A switch comprising:

a housing;

a key pivotally mounted on the housing;

a rocker switch having a first side facing the key and a second side facing away from the key, the first side of the rocker switch including a pair of actuating contours, each constituting a two-sided ramp having a peak; and first and second microswitches on the second side of the rocker switch;

wherein the key is pivotable in a first direction to pivot the rocker switch about a first axis to actuate the first microswitch, the key being pivotable in a second direction to pivot the rocker switch about a second axis spaced from the first axis to actuate the second microswitch, wherein the key cooperates with the peaks of the actuating contours to define a maximum permissible actuating travel distance of the rocker switch.

11. The switch according to claim 10, wherein the key includes a pair of spaced-apart actuating ribs that cooperate with the peaks of the actuating contours to define the maximum permissible actuating travel distance of the rocker switch.

* * * * *